US006223821B1

(12) United States Patent
Coronado

(10) Patent No.: US 6,223,821 B1
(45) Date of Patent: May 1, 2001

(54) INFLATABLE PACKER INFLATION VERIFICATION SYSTEM

(75) Inventor: Martin P. Coronado, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/199,603

(22) Filed: Nov. 25, 1998

Related U.S. Application Data

(60) Provisional application No. 60/066,602, filed on Nov. 26, 1997.

(51) Int. Cl.[7] ..... E21B 47/00
(52) U.S. Cl. ..... 166/250.01; 166/122
(58) Field of Search ..... 166/250.17, 250.01, 166/255.1, 250.07, 120, 122, 187

(56) References Cited

U.S. PATENT DOCUMENTS

| | | | | |
|---|---|---|---|---|
| 4,566,535 | * | 1/1986 | Sanford | 166/113 |
| 5,105,881 | * | 4/1992 | Thoms et al. | 166/250 |
| 5,555,945 | * | 9/1996 | Schultz et al. | 166/250.07 |
| 5,732,776 | * | 3/1998 | Tubel et al. | 166/250.15 |
| 5,767,398 | * | 6/1998 | Naedler | 73/146.2 |
| 5,803,167 | * | 9/1998 | Bussear et al. | 166/65.1 |
| 5,868,201 | * | 2/1999 | Bussear et al. | 166/53 |
| 6,050,131 | * | 4/2000 | Wiilauer | 166/250.01 |

FOREIGN PATENT DOCUMENTS

WO 98/09163 3/1998 (WO) .

OTHER PUBLICATIONS

H. Gai and G. Elliot, Monitoring and Analysis of ECP Inflation Status Using Memory Gauge Data,—(No Date).

* cited by examiner

*Primary Examiner*—Robert E. Pezzuto
*Assistant Examiner*—Nathan Mammen
(74) *Attorney, Agent, or Firm*—Cantor Colburn LLP

(57) ABSTRACT

An inflation verification system for an inflatable tool includes at least an information collector associated with the inflatable element of the inflatable tool connected to a controller with a predetermined set of instructions for inciting communications with the surface. Communicators contemplated include atmospheric chambers which when opened create a negative pressure pulse which propagates to the surface. More than one chamber increases the number of pulses generable and thus the amount of information conveyable. Alternative preferable communicators are electromagnetic pulse generators and acoustic telemetry. An advantage of acoustic telemetry is that more quantitative information is transmittable. Other downhole communication methods are also employable.

20 Claims, 7 Drawing Sheets

INFLATABLE PACKER INFLATION VERIFICATION SYSTEM

CROSS REFERENCE TO RELATED APPLICATIONS

This application claims the benefit of an earlier filing date from U.S. Provisional Application Ser. No. 60/066,602, filed Nov. 26, 1997.

BACKGROUND OF THE INVENTION

1. Field of the Invention

The invention relates to method and apparatus for verifying positive inflation of inflatable tools such as packers. More particularly, the invention relates to installing sensors within the inflatable tool, connecting the sensors to a controller which when it receives information from the sensors communicates the information to the surface using a device or procedure capable of so communicating.

2. Prior Art

Past methods for verifying positive inflation of inflatables such as an external casing packer (ECP) have been to monitor the pressure gauge employed to measure the applied pressure to inflate the packer. The applied pressure is provided either through an internal tubing string using an inflation tool or by pressuring the casing string in which the ECP is installed. When the ECP opens and begins inflating, fluid in the pressurized column begins to rapidly disperse in an amount equal to the displacement of the inflating packer. Where the ECP is large or is being inflated in a hole that is significantly larger than the outside diameter of the ECP in the uninflated condition the displaced fluid is of a relatively large volume. A large volume of fluid moving out of the pressurized column creates a pressure drop. The pressure drop occurs suddenly and is recognized by the gauge measuring the applied pressure. As long as the displaced volume is large the pressure drop is easily measured and noted and the setting of the packer is confirmed with high confidence. The method has been used for many years successfully and reliably on all larger ECP applications. Unfortunately, however, where the ECP is being set in a hole not much larger than its own uninflated outside diameter, the amount of fluid displaced into the packer is too small to be recorded by the gauge monitoring the applied pressure. This is not to say that the displaced fluid does not actually produce a pressure drop because indeed it does, it simply is to say that the drop in pressure is small because the displacement of fluid is small and the gauge employed to monitor applied pressure at many locations does not have sufficient resolution to detect the drop. Inflation of ECP's set in this type of environment cannot be confidently verified.

One prior art method that has been attempted to confirm positive inflation of an ECP in a hole not much larger than its own uninflated outside diameter is to measure displaced fluid from surface tanks. In situations where there is a long fluid column however, and the amount of fluid for inflation is very small the percentage of fluid depletion in the tanks may not be within a measurable range with equipment common at drilling sites. Therefore, the art is in need of a system for confidently verifying inflation of an inflatable tool such as an ECP which is inflated with a relatively small amount of displaced fluid.

Another prior art method to provide information about ECPs is not direct, but as a confirmation system. More specifically, memory pressure gauges are placed in an inflation tool and measure pressure in the packer. The gauges remember the pressure and can be downloaded after removal of the packer. Drawbacks to the system are that there is no real time information and the gauges only measure pressure. They do not in fact measure whether or not inflation has taken place. Thus the information supplied is helpful but not conclusive and not timely.

SUMMARY OF THE INVENTION

The above-discussed and other drawbacks and deficiencies of the prior art are overcome or alleviated by the method and apparatus of the invention.

The inflatable tool inflation verification system of the invention comprises employing an information collector in the interior of the inflatable tool or proximate thereto such as a pressure sensor or a fluid flow device such as a turbine. The pressure sensor would be calibrated to send a signal to a downhole controller in proximity with the inflatable tool when a predetermined pressure within the inflatable tool is reached or the flow device would send a signal when a predetermined volume of fluid (sufficient to fill the tool) has entered the tool. The controller activates a communication device to send confirmation of inflation to the surface. The addition of these devices makes for high confidence verification of inflation of ECPs inflated in holes not much larger than the ECPs uninflated outside diameter.

Confirmation may be sent to the surface in a number of ways but in one preferred method, which is preferred because it enables employing the same surface equipment, is to program the controller to open an atmospheric chamber of about 150 to about 250 cubic inches in volume attached to the inflatable tool itself which displaces fluid into the chamber and thus creates a pressure drop. The drop is significant because the differential between atmospheric pressure and the ambient pressure can be 5000 psi or more. This can be largely different from the pressure drop while inflating an ECP because the ECP inside the element is at well pressure as opposed to atmospheric pressure. Thus the pressure drop in the ECP will only be perhaps 1000 psi. As is appreciated it is more difficult to measure a 1000 psi drop than a 5000 psi drop in pressure. The pressure drop caused by flooding of the atmospheric chamber is easily measurable by a commercially available specially sensitive differential pressure monitoring gauge employed in the invention. Due to the method and apparatus of the invention, the verification of inflation of inflation tools employing only a small amount of displaced fluid (as well as larger ECPs) can be confidently confirmed. This is a great benefit to the industry both because it provides for verification of inflation and additionally the invention enables the use of conventional surface techniques with the improved equipment. In addition, more atmospheric chambers could be provided to add to the information gained at the surface.

Other modes in which confirmation may be sent to the surface are by supplying an electromagnetic pulse generator in the vicinity of the inflation tool and operably connected to the controller and by using acoustic telemetry through the pipe.

Although the foregoing summary of the invention discusses external casing packers specifically, it should be understood that any type of inflatable tool can benefit from the invention. As such, the detailed description which follows is directed generically to inflatable tools/inflatable elements.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENTS

Figure 1:
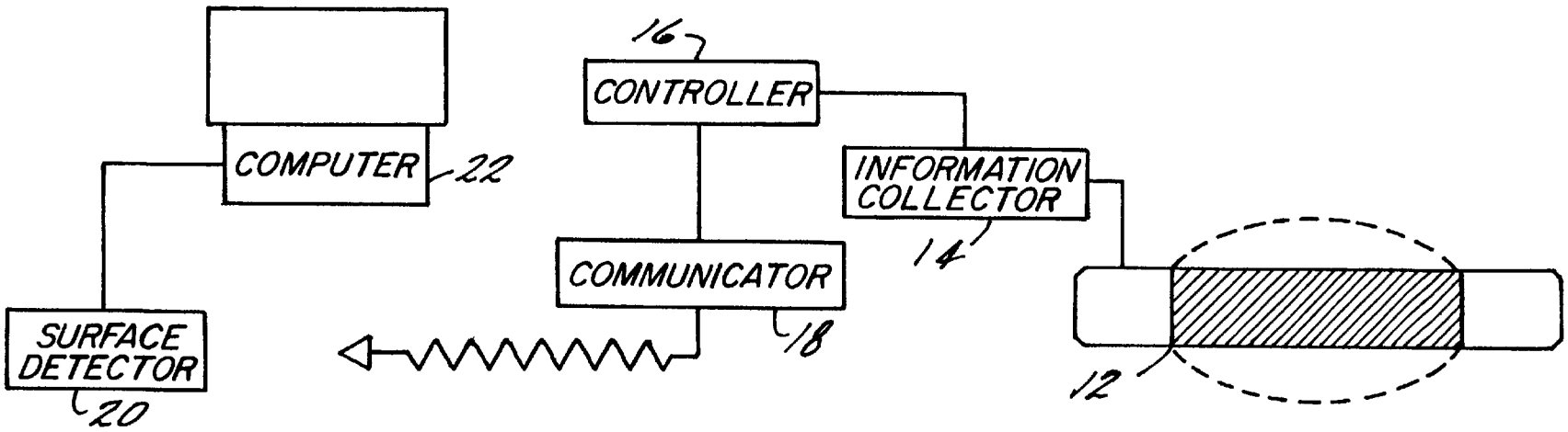
FIG. 1 is a schematic representation of the invention.
Figure 2:
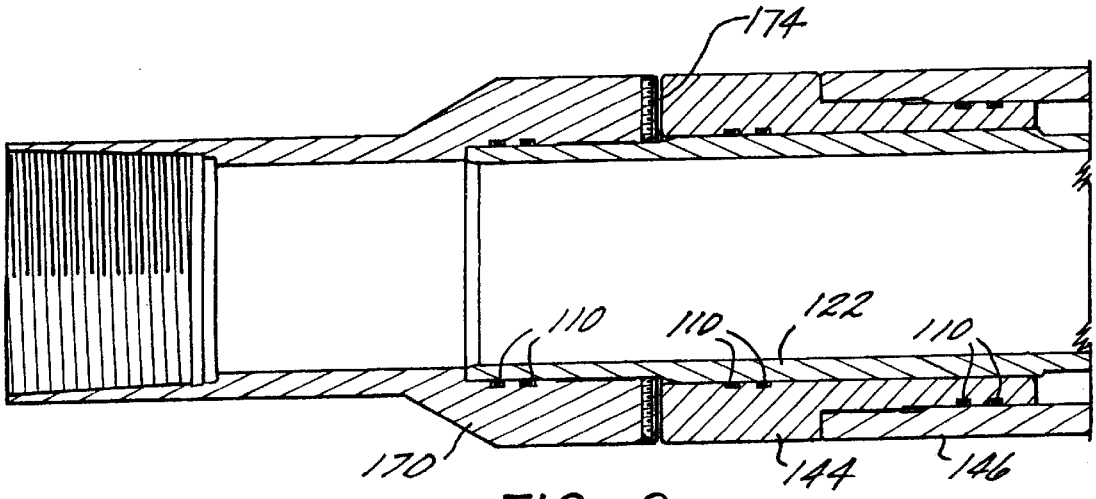
FIGS. 2–7 are an elongated view of a particular embodiment of the invention in the run in position.
Figure 8:
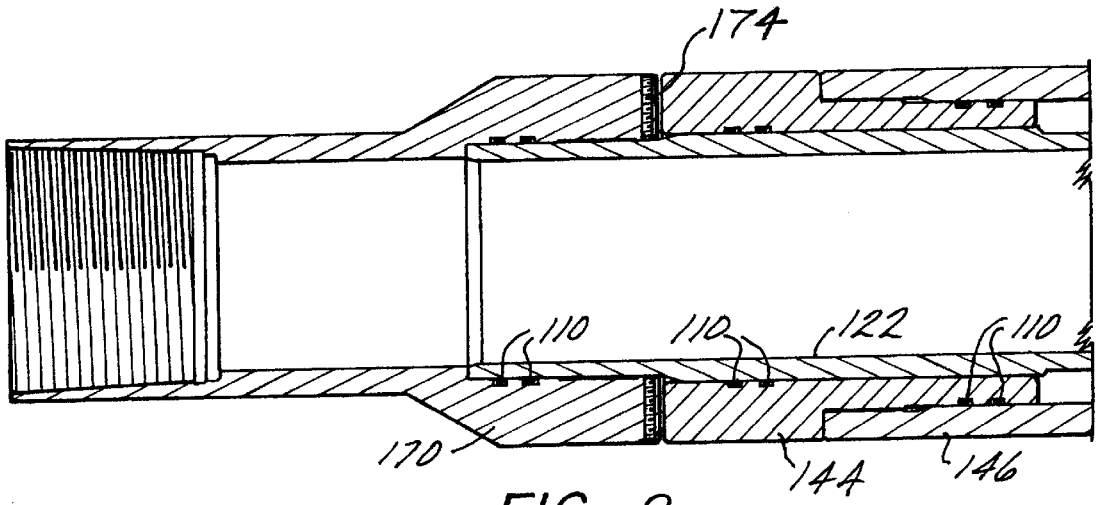
FIGS. 8–13 are an elongated view of a particular embodiment of the invention in the partially actuated position.
Figure 14:
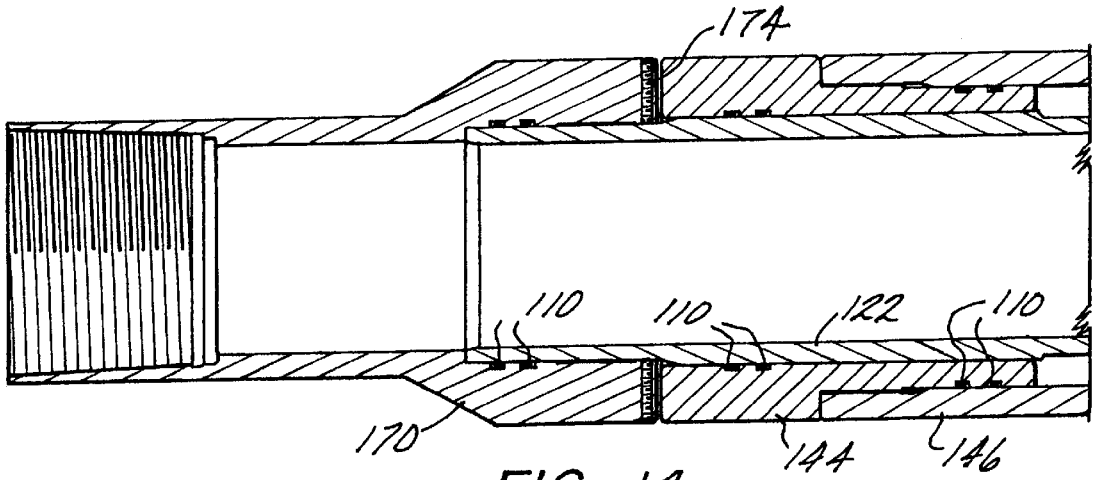
FIGS. 14–19 are an elongated view of a particular embodiment of the invention in the fully actuated position.
Figure 3:
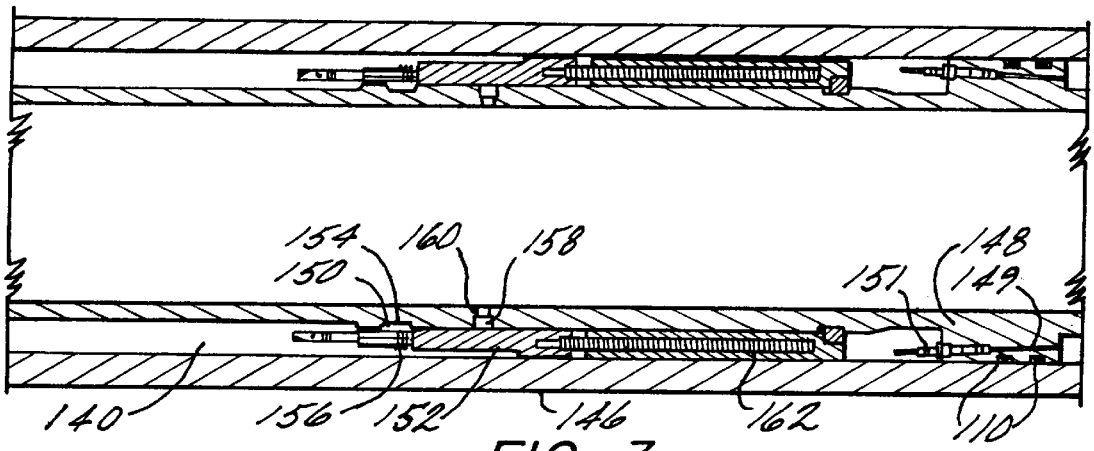

The invention solves an old problem by causing the parameters of the problem to fit into old methods thereby alleviating the problems. More specifically, by employing devices capable of measuring fixed parameters such as volume of fluid following therepast or pressure internal to an inflated tool and a controller to generate communication to the surface the problem of a low fluid displacement inflatable tool is solved. FIG. 1 is referred to provide an understanding conceptually of the components of the system hereinafter described in detail.

In all of the embodiments of the invention which follow, a sensor 14 or other type of information collector is employed within or adjacent an opening (not shown) in the inflatable tool which serves to allow fluid to enter the tool to inflate it. One preferred sensor is a pressure sensor disposed preferably adjacent to the packer. The sensor is preprogrammed to include a threshold differential pressure between the tool and the annulus before sending a millivolt impulse signal to the downhole controller 16 which, in turn, will activate the communicator 18. The pressure differential programmed into the sensor will be that pressure which has been predetermined to provide complete inflation of the inflatable tool. One of the other types of information collectors presently preferred is a fluid displacement device which would be located at the entrance to the inflatable portion of the inflatable tool. The device would replace or be in addition to sensor 14 and therefore is contemplated in the same flow chart box as is identified by numeral 14. In the case of the fluid displacement device, the amount of fluid flowing therepast is measured and when a threshold amount has passed, having been determined previously to be sufficient to completely deploy the inflatable element, the device sends an impulse to the controller 16 and the process continues as set forth above. In another embodiment of the invention, one or more strain gauges are employed as the sensor 14. These gauges are preferably mounted directly in the rubber cover of the packer and measure contact pressure with the open borehole or cased holes. Each of these embodiments of information collection are disposed proximately to where the information can most easily be accessed and therefore are quite reliable. With either embodiment the controller 16 is clearly advised that the inflatable tool 12 is deployed.

Communicating the information contained in the controller to the surface can be accomplished in a number of ways through a communicator 18 but preferably is by opening an atmospheric chamber, generating an electromagnetic pulse or by employing acoustic telemetry.

In the first preferred communication embodiment, a atmospheric chamber of about 150 to about 250 cubic inches in volume is built into the inflatable tool or is in a sub attached to the tool in proximty thereto. The chamber is openable at the instance of the controller. The atmospheric chamber is in effect the communicator 18 because when the chamber opens due to an action of controller 16, the chamber is rapidly flooded with fluid sufficiently to create a negative pressure pulse that is easily readable at the surface by surface detector 20. In this embodiment, surface detector 20 is a specially sensitive gauge the same gauge monitoring applied pressure. The pressure pulse read by detector 20 is then relayed either electronically to a computer 22 or directly to a technician by sight.

In an alternate iteration of the first embodiment, two atmospheric chambers are provided. The two chambers are opened at different times, the lapse of time between each negative pressure pulse produced thereby being correlated to the amount of actual pressure within the inflatable element. This provides valuable information uphole about the actual status of the inflatable element. In operation, the sensor or other information device 14 generates an impulse at a first differential value as discussed above. This is communicated to the controller which may immediately open a chamber or may time delay the opening to provide an opportunity for shut down of the rig pump. The pressure pulses are then more easily read at the surface. The first differential value is a minimum amount of pressure or fluid influx (or other predetermined parameter) to the inflatable element 12. In this alternate construction, a second impulse is generated when pressure stops climbing or fluid ceases to move into the element at a predetermined appreciable rate. Controller 16 is preprogrammed with a series of possible pressure ranges and is directed to open a second chamber a predetermined amount of time after the first depending upon which preprogrammed pressure range the sensor has signaled to the controller. Where a time delay for opening the first chamber is used to get beyond the time pumping is occurring, each of the signals will be easily measured at the surface and the time between the signals will provide information as to which final pressure range the element is in (e.g. between 875 and 925 psi the controller will wait 60 seconds between opening of chambers).

It should be understood that while the negative pressure pulse method of the invention is preferred, other methods are also available. For example, other preferable methods are to employ acoustic telemetry or electromagnetic pulse technology. Moreover, other downhole communications technology can also be adapted to be employed in the invention.

With respect to acoustic telemetry, additional quantitative benefits are realizable such as the ability to transmit annulus pressure; inflatable tool temperature, the degree to which the tool is inflated, etc. Of course it is necessary to provide sensors to read these parameters but information from as many sensors as are desired is transmittable via acoustic telemetry.

In the acoustic telemetry embodiment the communicator 18 is an acoustic transmitter and the surface detector 20 is an acoustic receiver. Basic acoustic telemetry is known to the art.

Another alternative communication method contemplated For the present invention is electromagnetic pulse technology. In employing this communication method the communicator 18 is an electromagnetic pulse generator and the surface detector 20 is adapted to receive the wavelengths produced.

In a particular embodiment of the negative pulse method and apparatus of the invention, referring to FIGS. 2–19, FIGS. 2–7 illustrate the tool in the first condition where two atmospheric chambers are sealed; FIGS. 8–13 illustrate the tool in a second condition where the first atmospheric chamber has been opened and the second atmospheric chamber is still closed; and FIGS. 14–19 illustrate the tool with both atmospheric chambers having been opened and the tool in its fully set and permanent position.

At the downhole end of the tool of the invention is attached conventionally a valve collar 100 and an inflatable packer 102. These are well known to the art and do not require explanation except to note that a pressure pathway 104 is provided in collar 100 to facilitate the function of the invention. Collar 100 is in contact with a connector sleeve 106 having an inflation and pressure test port 108 and o-ring seals 110. Port 108 leads to annular chamber 112 which is fed pressure through pathway 104 and terminates at conduit 114 leading to differential pressure transducer 116. Chamber 112 is formed by a space between connector sub 106 and transducer sub 120 relative to mandrel 122. Transducer housing 120 is also pressure sealed to mandrel 122 by o-ring seals 110. It should be noted that the pressure transducer 116 is a differential pressure transducer and so must be provided with pressure conduits leading to distinct pressure sources. The first has already been described and corresponds to the pressure inside the inflatable element of the packer 102; the second source of pressure is wellbore pressure and is accessed through a pair of ports 124 through cover sleeve 126 which extends over the transducer housing 120. Fluid from the wellbore fills the chamber 130 defined by the cover sleeve 126, transducer housing 120 and mandrel 122. An electrical connector such as a single pin connector 132 provides electrical/communication connection to pressure transducer 116 via wire (not shown). Connector 132 communicates through transducer housing 120 to microprocessor 134 by a conductor housed in conduit 133. This is the sensory portion of the invention and functions as follows: Pressure transducer 116 measures differential pressure between the internal space of the inflatable element of packer 102 and the wellbore pressure of chamber 130. The information sensed is communicated through the pathway indicated to microprocessor 134. Microprocessor 134 is programmed to allow current from battery pack 136 to run to the communication portion of the invention discussed hereunder only under specific circumstances and at specific times. Microprocessor allows current to run to a first pulse generator upon a 200 psi differential being sensed between the internal packer pressure and wellbore pressure, the packer being at the higher pressure and a second pulse generator at a second selected value of pressure differential between the two identified pressure sources and which is timed relative to the first pulse according to a predetermined ratio More specifically, the time between first and second generated pulses is directly related to the differential in pressure from the 200 psi threshold pulse and the ending packer pressure pulse. Specific knowledge as the ending pressure in the packer is in this way obtainable at the surface. It is preferable that the sequence of the microprocessor is delayed for some period of time of about five minutes after suspected setting is accomplished. Such a delay allows the well to "settle" after the pump has shut down which makes the pressure pulse communication method of the invention is easier to read at the surface.

Figure 9:
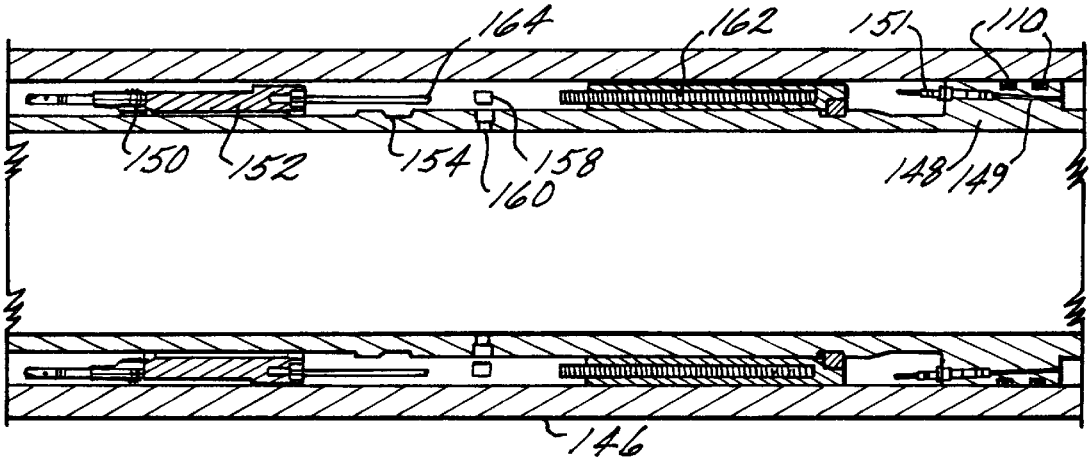
Figure 15:
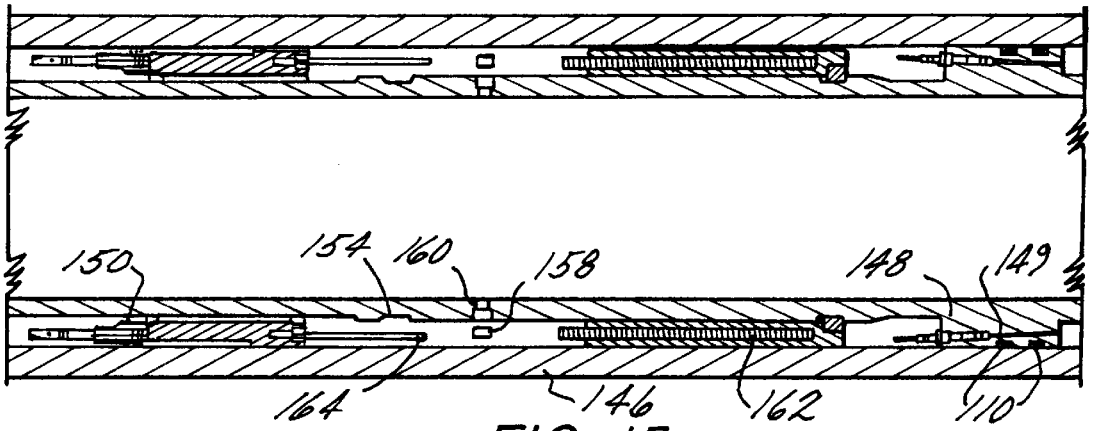
Figure 4:
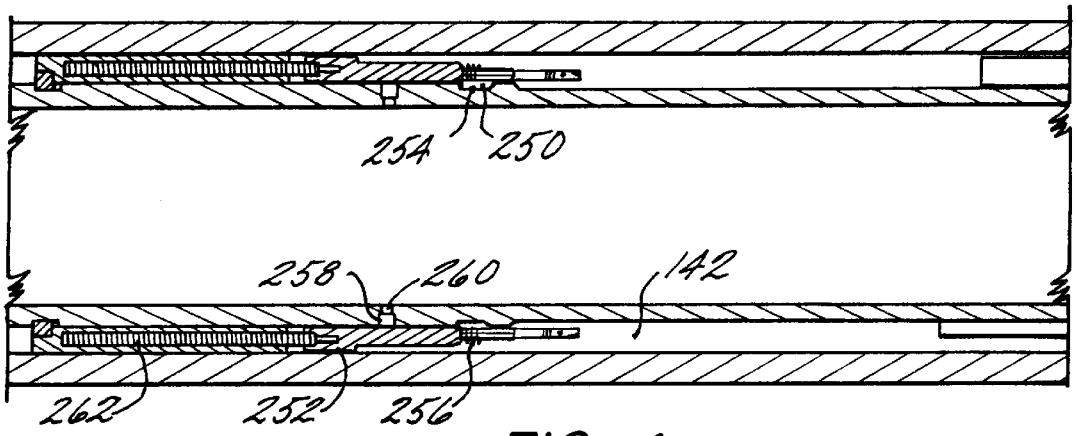
Figure 10:
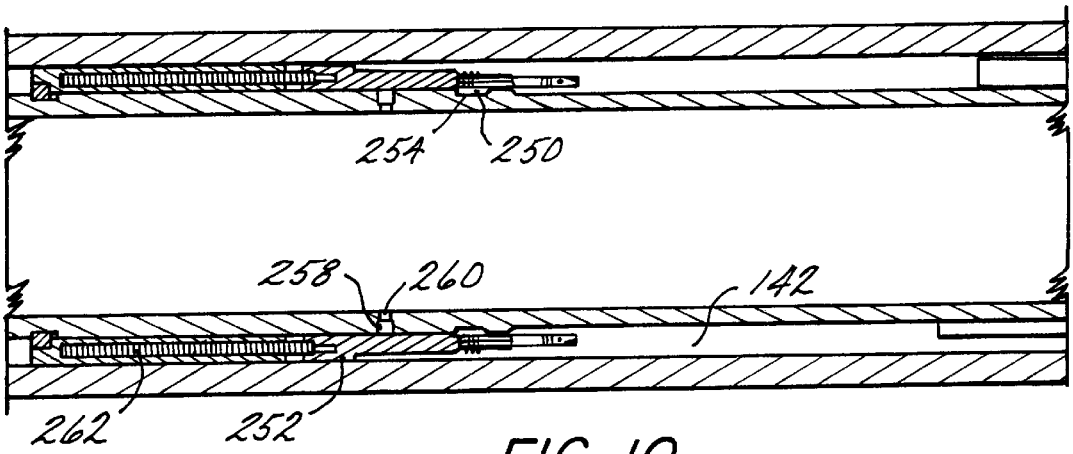
Figure 16:
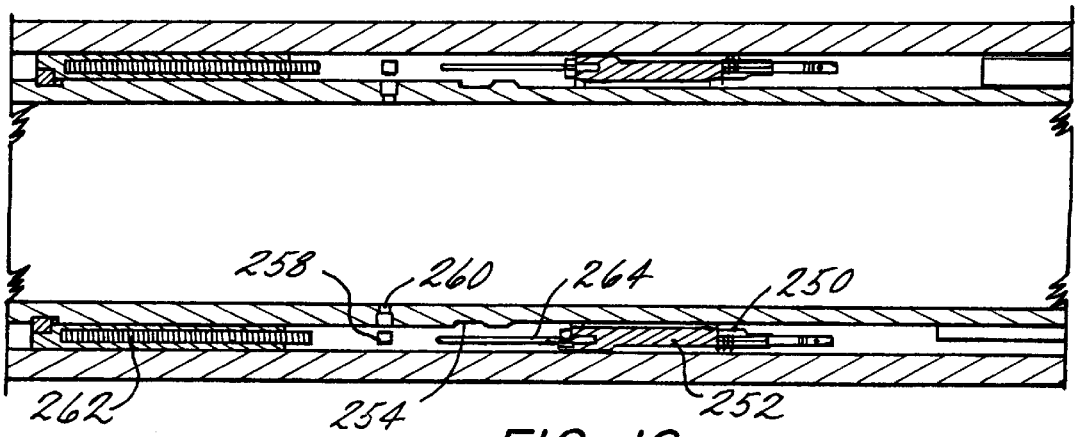
Figure 5:
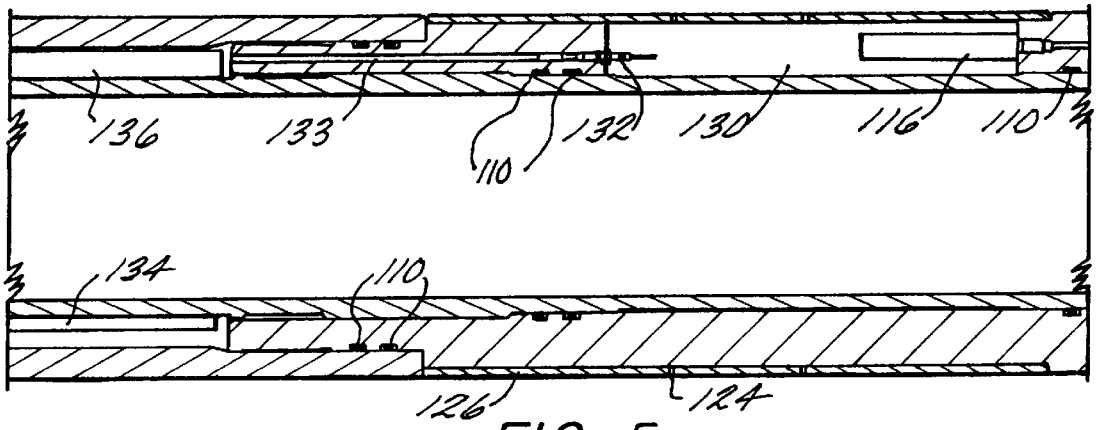
Figure 11:
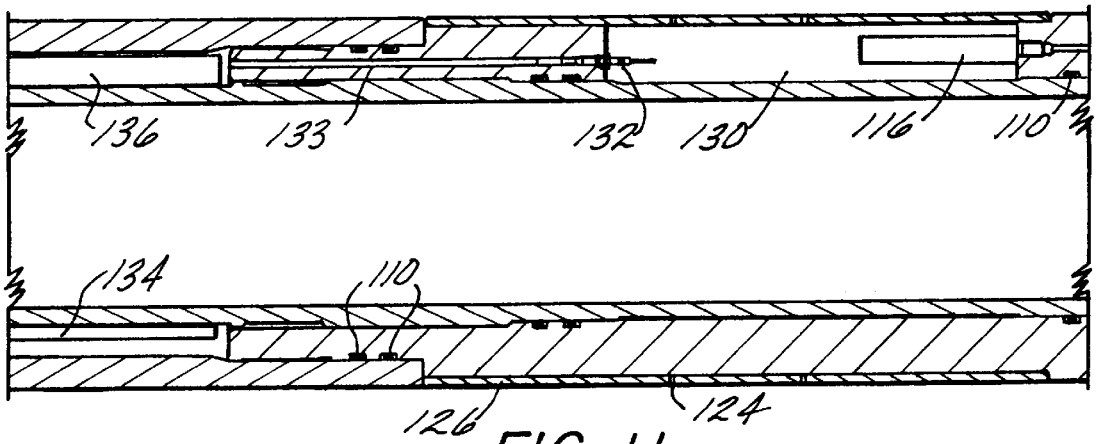
Figure 17:
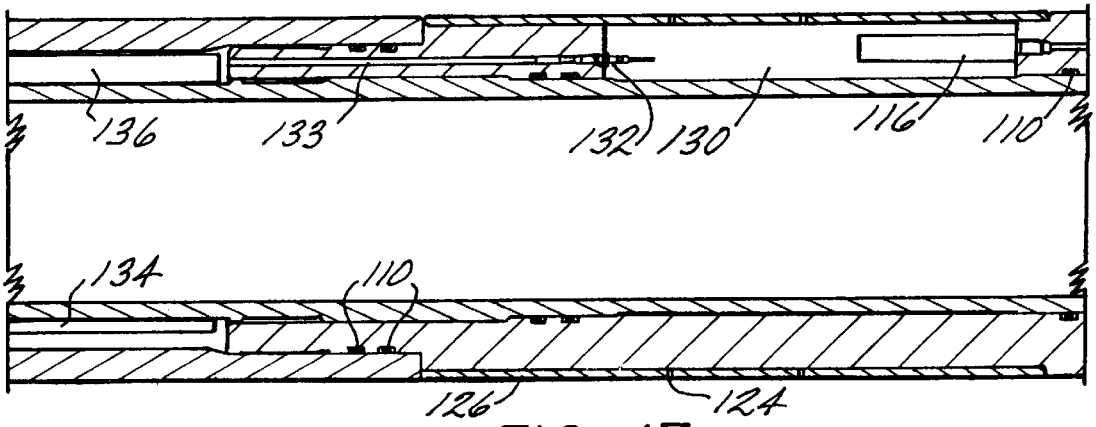
Figure 6:
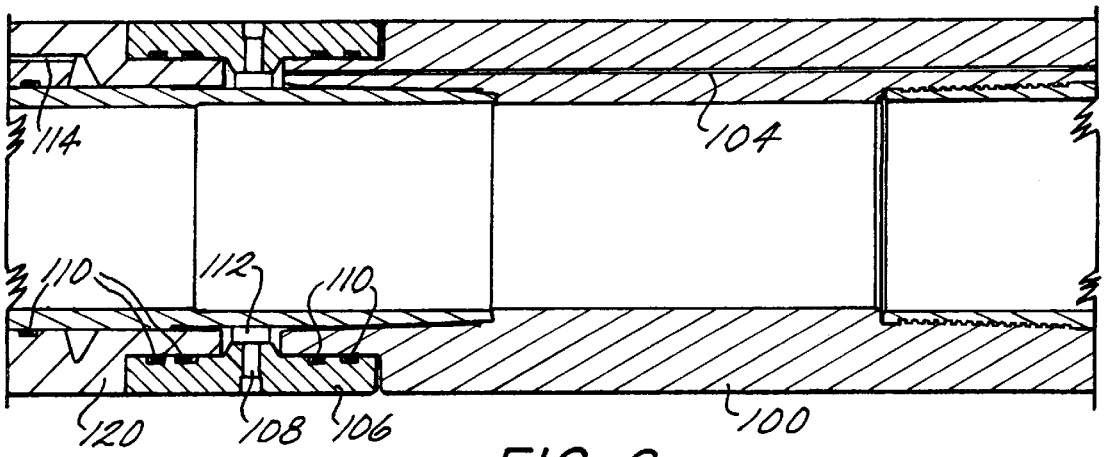
Figure 12:
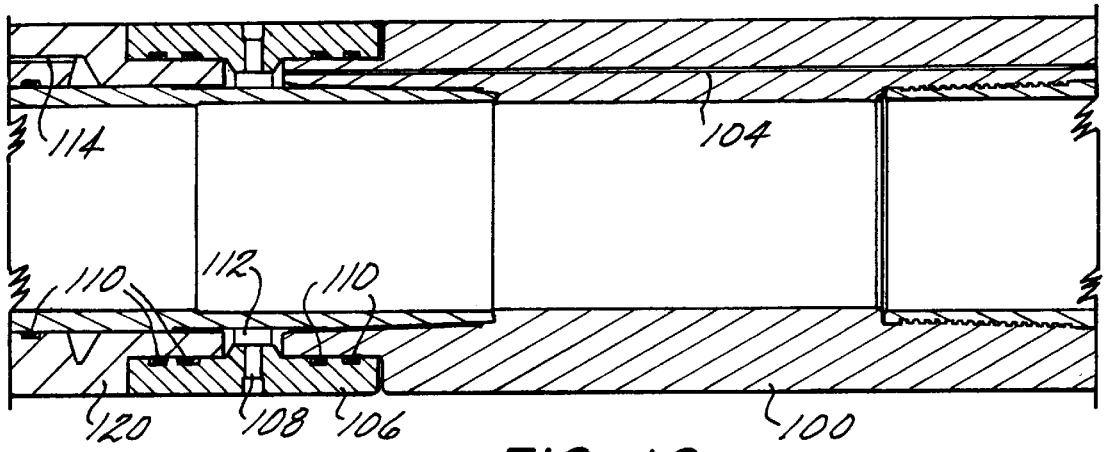
Figure 18:
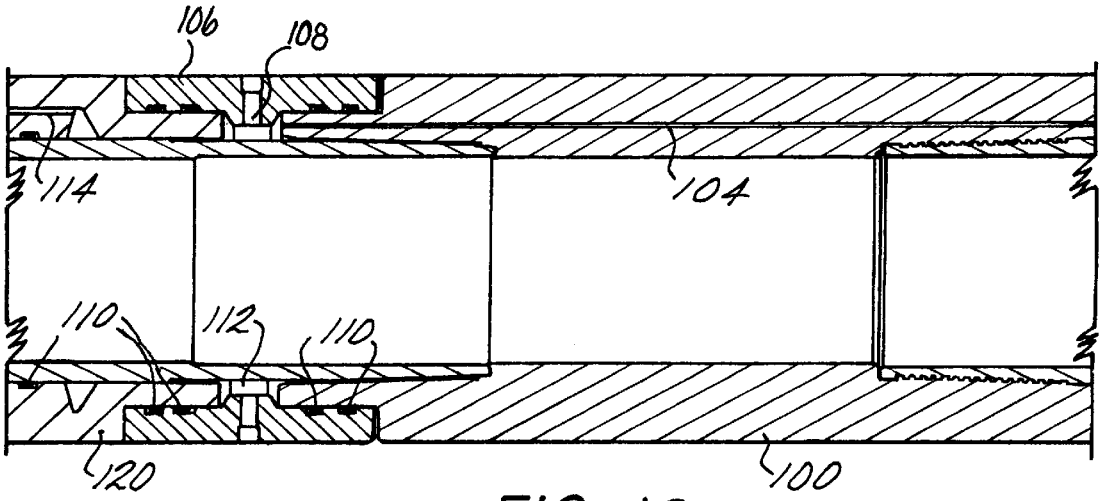
Figure 7:
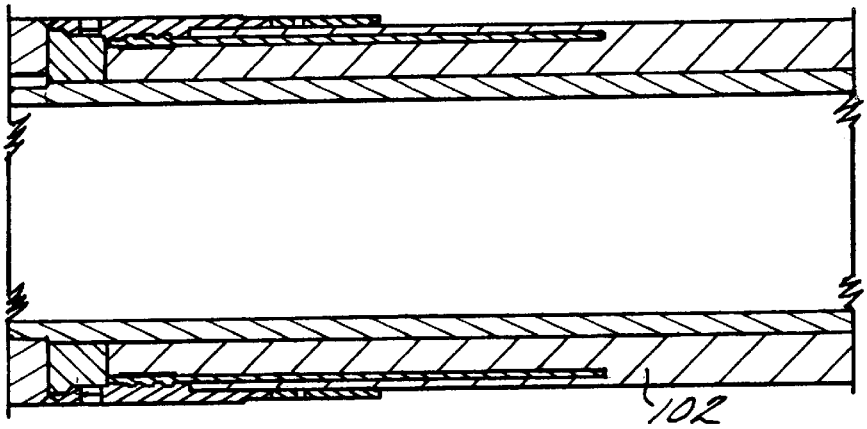
Figure 13:
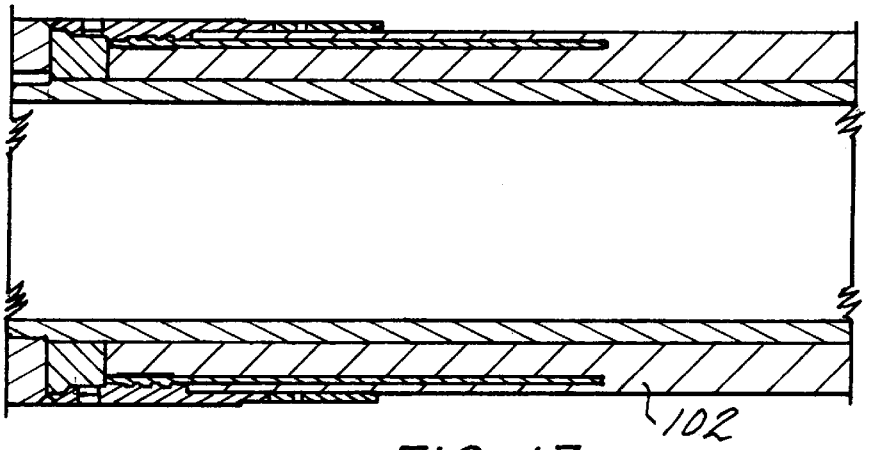
Figure 19:
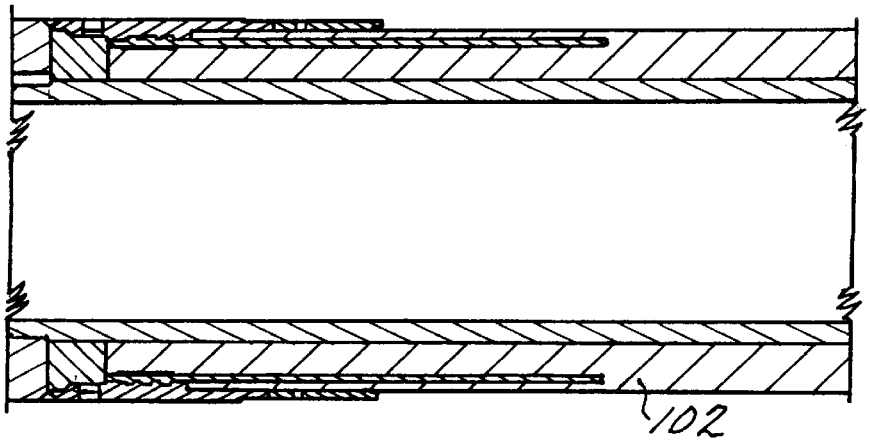

The communication portion of the invention is responsive to triggering by microprocessor 134. Specifically, the embodiment employs two atmospheric chambers 140 and 142. Microprocessor 134 and battery pack 136 are disposed within chamber 142. Chamber 140 is defined by housing connector 144, mandrel 122 and outer housing 146 whereas chamber 142 is defined by mandrel 122, transducer housing 120 and outer housing 146. The chambers are divided by bulkhead 148 of mandrel 122 which extends radially from mandrel 122 to seal against outer housing 146 with o-rings 110. Signals and power are transmitted through bulkhead 148 by conductor 149 and connector 151. Each chamber is provided with its own opening actuation device which is operable upon command from the microprocessor so that a negative pressure pulse is created. The devices are identical and are merely oppositely disposed. The first actuator includes locking dogs 150 mounted to a piston 152, which dogs are forced into engagement with groove 154 by Kevlar wire 156. In this condition piston 152 is maintained in a blocking position over plugs 158 in ports 160. Piston 152 is also in compressive contact with spring 162 which is charged so that piston 152 will be pushed off plugs 158 upon release of locking dogs 150. Preferably a spring guide pin 164 is provided as seen in FIG. 9.

The Kevlar 156 (high tensile strength, low heat resistance) is burned by current supplied by battery pack 136 on command of microprocessor 134 and delivered to a resistor element (not shown), which releases the dogs 150. Spring 162 then pushes piston 152 off plug 158 as stated. Plug 158 is only inserted into port 160 and so will easily be urged out of port 160 by the tremendous differential pressure between atmospheric chamber 140 at 14.7 psi and wellbore pressure which maybe many thousands of pounds of pressure per square inch. The atmospheric chamber 140 thus is immediately flooded with wellbore fluid. A pressure drop pulse is created hereby which will propagate to the surface signifying that about 200 psi has been registered in the packer as sensed by the transducer 116.

The second atmospheric chamber 142 is employed to provide information about how much ending pressure is within packer 102. Since second chamber 142 operates identically to chamber 140, but in the opposite direction in this embodiment, a second negative pressure pulse will be received at the surface upon activation thereof The elements are identified as similar and distinguished by changing the first number to the two hundred series, to wit: Dogs 250; piston 252; groove 254; Kevlar 256; plug 258; port 260; spring 262; and pin 264. Microprocessor 134 is programmed to allow a certain period of time to pass between flooding each chamber, which time is directly correlated to the amount of pressure in the packer above the pressure signaled by flooding the first chamber, in this embodiment, about 200 psi. For example, if the ending pressure in the packer happens to be 500 psi above wellbore pressure and the threshold pressure is 200 psi, the first chamber 140 will be flooded and three minutes later the second chamber 142 will be flooded. In this example, each minute of delay signifies 100 psi differential pressure over wellbore above the threshold pressure. By timing the negative pressure pulses then, (the pulses will travel at the same speed through the fluid column) a surface crew is able to verify precise set pressure of the packer.

It should be noted in this embodiment that chamber 140 is flooded first only because chamber 142 houses the microprocessor and battery pack and once flooded, these items rapidly become inoperable.

For completeness, the uphole end of the tool includes top sub 170 which is threaded to mandrel 122 at thread 172 and maintained there with set screw 174. Seals are supplied in the illustrated positions to maintain specific pressure areas separate as is understood by one of skill in the art.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An inflation verification system for use in a wellbore comprising:

an inflatable downhole tool disposed downhole in the wellbore;

at least one pressure sensor mounted adjacent said inflatable downhole tool, said sensor emitting a signal to a controller, said controller determining the existence of a predetermined differential pressure between said inflatable downhole tool and pressure in an annulus of the wellbore;

a controller in communication with said downhole tool and adapted to receive said signal emitted from said at least one pressure sensor;

a communicator operably connected to said controller; and a receiver remote from said communicator and capable of receiving information therefrom.

2. An inflation verification system as claimed in claim 1 wherein said controller upon receiving said signal directs said communicator to communicate with said receiver.

3. An inflation verification system as claimed in claim 1 wherein said communicator is at least one atmospheric chamber in said inflatable downhole tool, said controller opens said atmospheric chamber in response to receipt of said signal whereafter said chamber floods with fluid creating a pressure drop which is propagated to said receiver to thereby confirm inflation of said inflatable downhole tool.

4. An inflation verification system as claimed in claim 3 wherein said at least one atmospheric chamber is at least two atmospheric chambers, and said at least one pressure sensor further communicates with said controller, a first of said atmospheric chambers being opened by said controller upon receiving a first signal threshold and a second chamber being opened by said controller upon receiving a second signal threshold whereby sequential pressure pulses are propagated uphole and received by said receiver thereby indicating the degree of deployment of said inflatable element.

5. An inflation verification system as claimed in claim 2 wherein said communicator is an acoustic telemetry communicator and said receiver is an acoustic telemetry receiver.

6. An inflation verification system as claimed in claim 5 wherein said at least one pressure sensor is a plurality of pressure sensors and said acoustic telemetry communicator transmits quantitative information provided by said controller to said communicator and which was received by said controller from said plurality of pressure sensors to said receiver.

7. An inflation verification system as claimed in claim 2 wherein said communicator is an electromagnetic pulse generator.

8. A method for verifying inflation of an inflatable downhole tool comprising:

providing an inflatable downhole tool having at least one information collector mounted in communication with an inflatable element of said tool, a controller connected to said at least one information collector and a communicator associated therewith;

installing said tool in a wellbore;

providing a receiver remote from said tool and adapted to receive information from said communicator;

communicating through the opening of at least one atmospheric chamber which is opened at a selected time according to a program;

inflating said inflatable downhole tool; and reading information communicated to said receiver.

9. A method as claimed in claim 8 wherein two atmospheric chambers are used to communicate in said communicating, said chambers being opened sequentially according to a program and sequence of events.

10. A method as claimed in claim 8 wherein said reading includes sensing a negative pressure pulse at a surface location.

11. A method as claimed in claim 10 wherein said reading further includes sensing a second pressure pulse at said surface location and timing the period there between.

12. An inflatable tool having a housing and an inflatable element the improvement comprising:

at least one information collector located to perceive a predetermined parameter of inflation of said element;

a controller in proximity to said tool adapted to receive a signal emitted from said at least one information collector upon said at least one information perceiving at least one threshold value of the predetermined parameter;

a communicator comprising at least one atmospheric chamber openable by said controller to create a negative pressure pulse, said communicating being connected to said controller and capable of communicating with a remote receiver by said negative pressure pulse.

13. The improvement as claimed in claim 12 wherein said negative pressure pulse is propagated to said receiver.

14. The improvement as claimed in claim 13 wherein said at least one atmospheric chamber is at least two atmospheric chambers which are openable independently by said controller upon a predetermined program of said controller.

15. The improvement as claimed in claim 14 wherein said predetermined program is the receipt of two signals from said at least one information collector, one of said atmospheric chambers being openable on a first signal and the second atmospheric chamber being openable on a second signal whereby time delay between pulses created by opening of said chambers is correlated to specific predetermined parameters of said inflatable tool.

16. The improvement as claimed in claim 12 wherein said communicator is an electromagnetic pulse generator.

17. The improvement as claimed in claims 12 wherein said communicator is an acoustic telemetry device.

18. The improvement as claimed in claim 17 wherein said acoustic telemetry device communicates quantitative information to said remote receiver.

19. An inflation verification system for use in a wellbore comprising:

an inflatable downhole tool disposed downhole in the wellbore;

at least one information collector located downhole to perceive information regarding the degree of inflation of said inflatable downhole tool, said at least one information collector emitting a signal upon sensing movement of a delayed opening valve, said valve said communicator is at least one atmospheric chamber in said inflatable downhole tool, requiring a predetermined pressure be reached before opening to allow fluid entry to said inflatable downhole tool;

a controller in communication with said downhole tool and adapted to receive said signal emitted from said at least one information collector;

a communicator operably connected to said controller; and a receiver remote from said communicator and capable of receiving information therefrom.

20. A method for verifying inflation of an inflatable downhole tool comprising:

providing an inflatable downhole tool having at least one information collector mounted in communication with an inflatable element of said tool, a controller connected to said at least one information collector and a communicator associated therewith;

installing said tool in a wellbore;

providing a receiver remote from said tool and adapted to receive information from said communicator;

communicating;

inflating said inflatable downhole tool;

delaying information sent from said communicator for a period of time sufficient to allow a well in which the tool is employed to settle; and reading information communicated to said receiver.

* * * * *

UNITED STATES PATENT AND TRADEMARK OFFICE

CERTIFICATE OF CORRECTION

PATENT NO. : 6,223,821 B1
DATED : May 1, 2001
INVENTOR(S) : Martin P. Coronado

It is certified that error appears in the above-identified patent and that said Letters Patent is hereby corrected as shown below:

Title page,
Item [56], References Cited, U.S. PATENT DOCUMENTS, delete "Wiilauer" and insert therefor -- Willauer --

Column 5,
Line 50, after "ratio" insert therefor -- . --

Column 6,
Line 37, after "thereof" and insert therefor -- . --
Line 62, after "Seals" insert therefor -- 110 --

Column 8,
Line 49, after "in" delete "claims" and insert therefor -- claim --
Line 59, after "valve" (second occurrence) delete "said communicator is at least one atmospheric chamber in said inflatable downhole tool,"

Signed and Sealed this

Twenty-eighth Day of December, 2004

JON W. DUDAS
*Director of the United States Patent and Trademark Office*